United States Patent [19]

Seiden

[11] Patent Number: 4,733,868

[45] Date of Patent: Mar. 29, 1988

[54] GOLF PRACTICE CLUB

[76] Inventor: Amy Seiden, 514 Sycamore Ter., Cinnaminson, N.J. 08077

[21] Appl. No.: 945,919

[22] Filed: Dec. 23, 1986

[51] Int. Cl.[4] ..... A63B 69/36

[52] U.S. Cl. ..... 273/194 R; 273/80 D; 242/84.1 A

[58] Field of Search ..... 273/200 R, 80 D, 194 R, 273/186 A, 162 R, 162 E, 162 F, 81.2, 80 B; 43/21, 18.1; 242/84.1 A, 54 R

[56] References Cited

U.S. PATENT DOCUMENTS

| | | | |
|---|---|---|---|
| 2,107,983 | 2/1938 | Hamilton | 273/80 D |
| 3,065,563 | 11/1962 | Basrom | 273/200 R X |
| 3,191,880 | 6/1965 | Visconti | 273/200 R X |
| 3,424,464 | 1/1969 | Greenhouse | 273/162 R |
| 3,528,660 | 9/1970 | Kategian | 273/80 D |
| 3,561,695 | 2/1971 | Wood | 248/84.1 A |
| 3,862,509 | 1/1975 | Petersen | 43/18.1 |
| 3,947,141 | 3/1976 | Casset | 43/18.1 |
| 4,239,227 | 12/1980 | Davis | 273/194 R X |
| 4,526,374 | 7/1985 | Ban | 273/200 R X |

*Primary Examiner*—George J. Marlo
*Attorney, Agent, or Firm*—Norman E. Lehrer

[57] ABSTRACT

A portable golf practicing device includes a golf club such as a putter having a head at one end, a handle at the other and a telescoping shaft therebetween. The telescoping shaft allows the club to be collapsed for storage or carrying and to be extended so that it can be used in a normal manner. A spinning type fishing reel is mounted adjacent the handle and includes a spool of line therein. The line extends through a plurality of eyelets mounted on the shaft and the end is secured to a golf ball. The reel is equipped with an electric motor for automatically rewinding the line when it is drawn out after the ball is hit. A hollow chamber in the handle provides a space for a plurality of batteries.

7 Claims, 4 Drawing Figures

GOLF PRACTICE CLUB

BACKGROUND OF THE INVENTION

The present invention is directed toward a portable golf practicing device and more particularly toward a golf club having a telescoping shaft and a ball retrieval system such as a fishing reel attached thereto.

Golf clubs with telescoping shafts have been proposed in the past. One such golf club is shown, for example, in U.S. Pat. No. 3,424,464. This patent shows a golf club in the form of a putter which has a telescoping shaft and which is intended primarily as a novelty item. The putter is mounted on a small stand which has an open front and can, therefore, function as a practice cup. Thus, the putter can actually be used by an executive or the like practicing putting in his office.

A golf club with a telescoping shaft is also shown in U.S. Pat. No. 2,107,983. This patent is directed toward a club which is intended to be actually used on a golf course and which can be adjusted during the course of play to the effective length desired without materially disturbing the balance of the club. This patent, as with the prior patent described above, is directed toward a golf club only and includes no means for retrieving a ball after it has been hit.

Golf clubs have also been proposed which include retrieval devices in combination therewith so that a ball can be retrieved after it has been hit. These prior devices include fishing reels attached near the handle of the golf club as shown, for example, in U.S. Pat. Nos. 3,065,563 and 4,526,374.

The first-mentioned patent includes a fishing reel which is relatively permanently fixed to the golf club handle and the shaft of the golf club includes a plurality of eyelets secured thereto for guiding the line. The second patent, on the other hand, includes a fishing reel carried by its own bracket which is adapted to be secured to substantially any golf club. In both cases, the end of the line is secured to a golf ball.

While each of the devices shown in U.S. Pat. Nos. 3,065,563 and 4,526,374 show the use of a retrieval device in the form of a fishing reel, the devices are used on substantially conventional golf clubs. There is no suggestion in these patents that the golf club be provided with a telescoping shaft. Furthermore, the fishing reels must be manually rewound in order to retrieve the ball after it has been hit. No automated means for retrieving the ball is proposed.

SUMMARY OF THE INVENTION

The present invention adopts the various advantageous features of each of the prior art patents described above and includes additional features which result in a greatly improved product. The portable golf practicing device of the invention includes a golf club such as a putter having a head at one end, a handle at the other and a telescoping shaft therebetween. The telescoping shaft allows the club to be collapsed for storage or carrying and to be extended so that it can be used in a normal manner. A spinning type fishing reel is mounted adjacent the handle and includes a spool of line therein. The line extends through a plurality of eyelets mounted on the shaft and the end is secured to a golf ball. The reel is equipped with an electric motor for automatically rewinding the line when it is drawn out after the ball is hit. A hollow chamber in the handle provides a space for a plurality of batteries.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
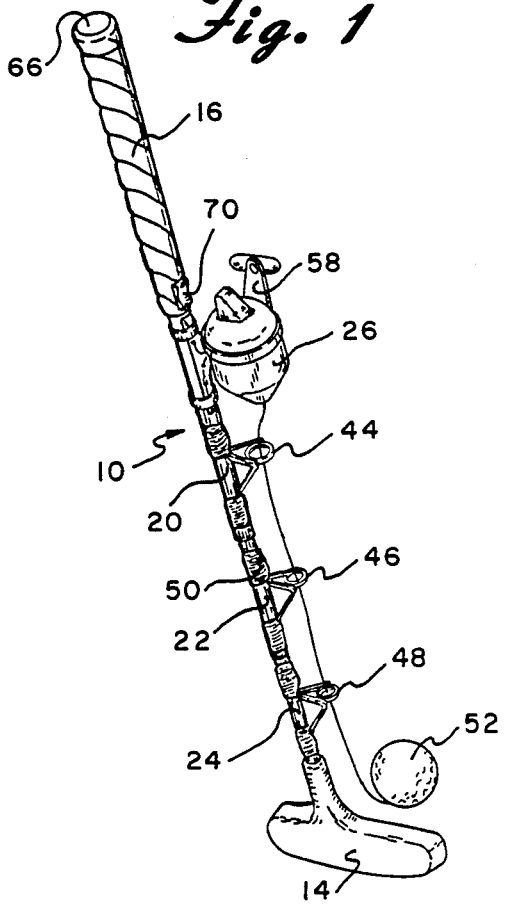
FIG. 1 is a perspective view of the portable golf practicing device constructed in accordance with the principles of the present invention and shown in its collapsed form.
Figure 2:
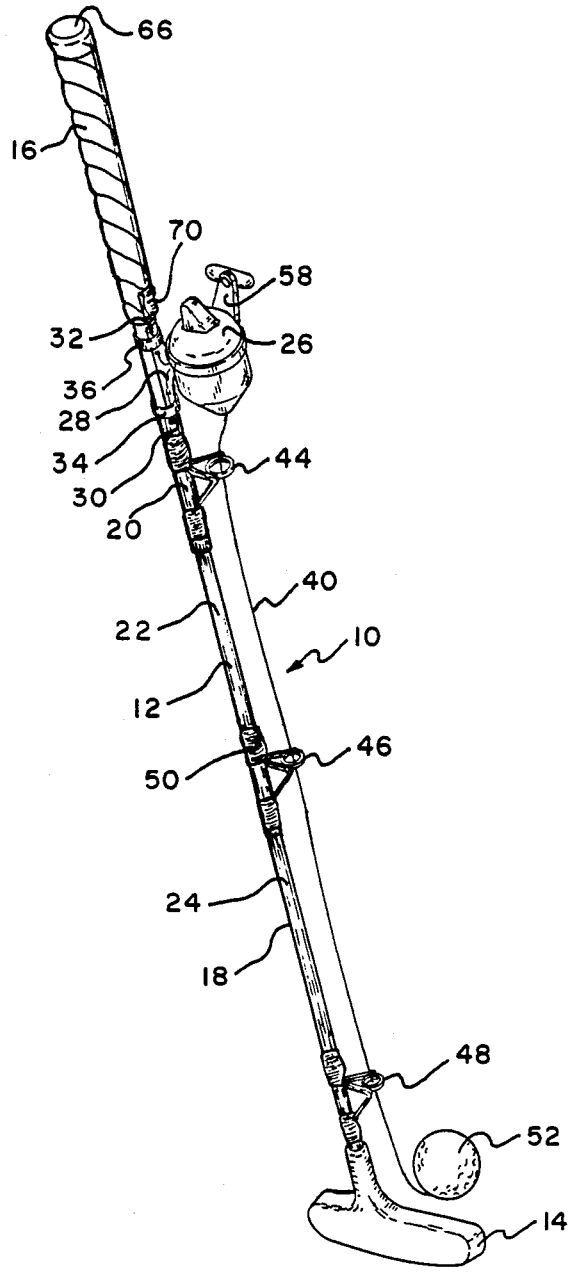
FIG. 2 is a view similar to FIG. 1 but showing the device in its telescoped or extended form.

Referring now to the drawings in detail wherein like reference numerals have been used throughout the various figures to designate like elements, there is shown in FIGS. 1 and 2 a portable golf practicing device constructed in accordance with the principles of the present invention and designated generally as 10. The practicing device 10 is shown in its collapsed form in FIG. 1 wherein it can be easily transported and is shown in its fully extended form in FIG. 2 ready for use.

The device 10 is comprised essentially of a golf club 12 having a head 14 at the lower end thereof and a handle 16 at the other end. While the head 14 is shown as a conventional putting head, this is by way of example only as substantially any type of golf club head may be utilized. The handle 16 is preferably of conventional shape and size.

Figure 3:
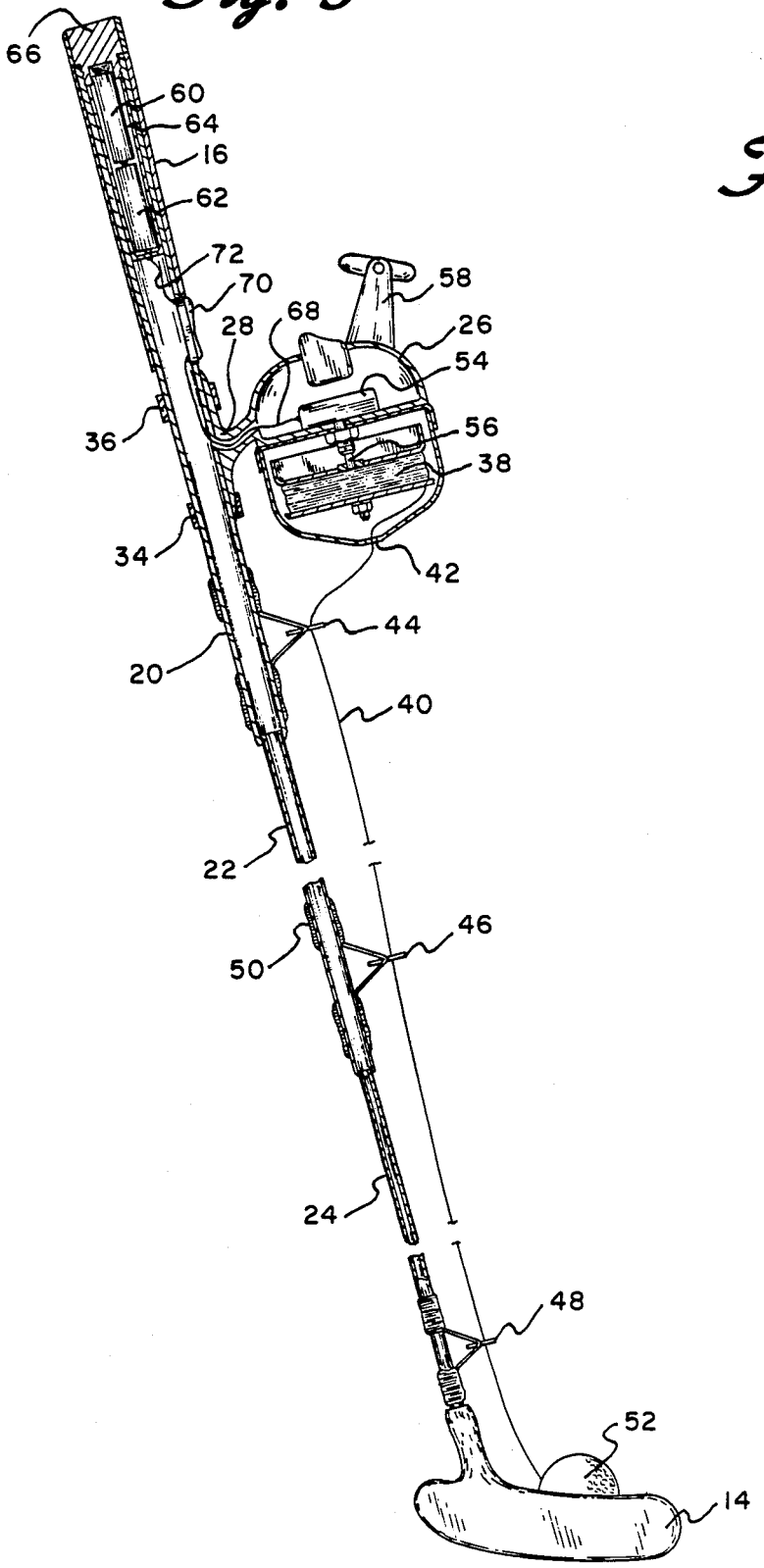
FIG. 3 is an elevational view of the device shown in FIG. 2 and shown partially in cross section for illustration purposes.
Figure 4:
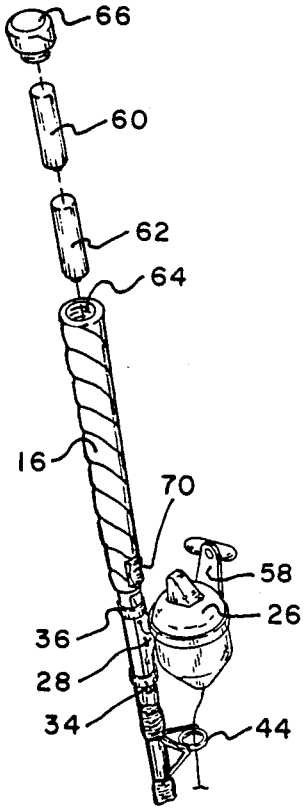
FIG. 4 is an exploded view of the handle portion of the device.

Extending between the head 14 and handle 16 is a shaft 18 which is comprised of a plurality of telescoping sections 20, 22 and 24. As can best be seen from FIG. 3, each of the telescoping sections 20, 22 and 24 is substantially tubular in shape with the upper section 20 being slightly larger than the intermediate section 22 which, in turn, is slightly larger than the lower section 24. The telescoping sections are intended to telescope into each other so that the shaft 18 can be collapsed as shown in FIG. 1 or can be fully extended as shown in FIG. 2. In its fully extended condition, the golf club 12 will be substantially the same size as a conventional golf club.

Mounted on the upper shaft section 20 is a spinning type fishing reel 26. Reel 26 includes a base 28 having flanges 30 and 32 extending therefrom which are adapted to be secured to the shaft portion 20 through the use of retaining rings 34 and 36. The reel 26 includes a spool 38 of line 40 which extends from the front opening 42 thereof.

The lower part of each of the shaft portions 20, 22 and 24 includes an eyelet such as shown at 44, 46 and 48. These eyelets are conventional eyelets such as are normally used with fishing rods and are secured to their respective shaft portions through the use of tape or wire or the like such as shown at 50 on eyelet 46 which secures the legs of the eyelet to the shaft. The line 40 passes through each of the eyelets 44, 46 and 48 and has its free end secured to golf ball 52. Preferably golf ball 52 is a conventional golf ball of standard size and weight with the line being secured through a small hole in the golf ball so as to minimize any disturbances on the outer surface thereof.

The reel 26 may be a substantially conventional spinning type fishing reel such as shown in U.S. Pat. No. 4,526,374. Accordingly, a detailed description of the operation of the reel is not believed to be necessary. However, it is also preferred to provide the reel with an automatic rewinding mechanism in the form of a small electric motor 54 which may be used to automatically rewind the line 40 onto the spool 38 after the ball 52 has been struck and the line is drawn out of the reel. Motor 54 is preferably a small D.C. motor which may be secured directly to the shaft 56 of the spool 38. When utilizing a reel including an electric motor, the reel crank 38 could be removed or it can remain on so that either a manual or automatic operation would be possible.

Power for the motor 54 is provided by a pair of batteries 60 and 62 which are fitted into hollow chamber 64 formed in the handle 16. The upper free end of the handle 16 has a removable cap 66 which functions to maintain the batteries 60 and 62 in place and also serves as the electrical terminal for the negative side of the battery source. As should be readily apparent to those skilled in the art, the motor 54 has one of its electric leads grounded to metal casing of the reel 26 so that the reel, its base 28 and the shaft portion 20 of the golf club function as the negative electrical connection to the motor 54.

The positive connection to the motor 54 is provided by lead 68 which passes through an opening in the base 28 of the reel 26 and is connected to switch 70. The positive lead from the batteries is also connected to the switch 70 through wire 72. Switch 70 may be a momentary contact switch or a slide switch and is mounted on the upper surface of the upper shaft portion 20 adjacent the handle 16. The switch 70 is located in a position so that it would immediately underlie the golfer's thumb when properly holding the golf club. In this way, after hitting the ball, the golfer merely has to depress the switch 70 to activate the motor 54 thereby retrieving the ball without having to change his position or move his grip.

The present invention may be embodied in other specific forms without departing from the spirit or essential attributes thereof and accordingly reference should be made to the appended claims rather than to the foregoing specification as indicating the scope of the invention.

I claim:

1. A portable golf practicing device comprising:

a golf club including a head at one end thereof, a handle at the other end and a shaft extending between said head and said handle;

said shaft being comprised of a plurality of telescoping sections each of which has a lower end and an upper end, said telescoping sections being movable between a collapsed condition and an extended condition;

a spinning reel mounted on said shaft adjacent said handle, said spinning reel including a spool of line therein and payable therefrom and including means for rewinding said line into said reel after it has been paid out;

a plurality of eyelets positioned along said shaft, each eyelet being mounted on a different telescoping section and adjacent the lower end thereof, said line passing from said reel and through said eyelets, and a golf ball secured to the free end of said line.

2. The invention as claimed in claim 1 wherein said means for rewinding said line includes an electric motor mounted within said reel.

3. The invention as claimed in claim 2 further including an electric switch carried by said handle for activating said motor.

4. The invention as claimed in claim 3 wherein said handle includes an upper surface which normally underlies a golfer's thumbs when said club is being used and wherein said switch is located on said upper surface.

5. The invention as claimed in claim 2 further including a battery carried by said handle.

6. The invention as claimed in claim 5 wherein said handle has a hollow chamber therein and wherein said battery is located within said chamber.

7. The invention as claimed in claim 6 wherein the upper end of said handle has a removable cap thereon covering said chamber, said battery being insertable into said chamber through said upper end when said cap is removed.

* * * * *